US011845195B2

(12) United States Patent
Fox et al.

(10) Patent No.: US 11,845,195 B2
(45) Date of Patent: Dec. 19, 2023

(54) PIVOTING BLADE ASSEMBLY FOR HIGH-SPEED FOOD SLICING MACHINE

(71) Applicant: Provisur Technologies, Inc., Chicago, IL (US)

(72) Inventors: Gage A. Fox, Manhattan, IL (US); Glen F. Pryor, Manhattan, IL (US); Ryan M. Torrenga, Bourbonnais, IL (US); Ryan J. O'Connor, Clarendon Hills, IL (US)

(73) Assignee: PROVISUR TECHNOLOGIES, INC., Chicago, IL (US)

( * ) Notice: Subject to any disclaimer, the term of this patent is extended or adjusted under 35 U.S.C. 154(b) by 577 days.

(21) Appl. No.: 16/791,054

(22) Filed: Feb. 14, 2020

(65) Prior Publication Data

US 2020/0269459 A1 Aug. 27, 2020

Related U.S. Application Data

(60) Provisional application No. 62/809,066, filed on Feb. 22, 2019.

(51) Int. Cl.
*B26D 5/02* (2006.01)
*B26D 1/28* (2006.01)
(Continued)

(52) U.S. Cl.
CPC ..... *B26D 5/02* (2013.01); *B26D 1/28* (2013.01); *B26D 5/08* (2013.01); *B26D 7/0625* (2013.01); *B26D 7/32* (2013.01); *B26D 2210/02* (2013.01)

(58) Field of Classification Search
CPC ..... Y10T 83/8748; Y10T 83/8749; Y10S 83/932; B26D 2210/02; B26D 5/02;
(Continued)

(56) References Cited

U.S. PATENT DOCUMENTS 2,747,633 A 5/1956 Burlin
4,532,840 A 8/1985 Antonissen
(Continued)

FOREIGN PATENT DOCUMENTS

DE 102009056670 A1 * 6/2011 ..... B26D 1/143
DE 102012109003 A1 * 12/2013 ..... B26D 1/28
(Continued)

OTHER PUBLICATIONS

Slocum, Alexander; FUNdaMENTALS of Design; 2008; obtained from https://meddevdesign.mit.edu/wp-content/uploads/simple-file-list/FUNdaMentals-Chapters/FUNdaMENTALs-Topic-4.pdf on Mar. 16, 2023 (Year: 2008).*
(Continued)

*Primary Examiner* — Evan H MacFarlane
(74) *Attorney, Agent, or Firm* — KLINTWORTH & ROZENBLAT IP LLP

(57) ABSTRACT

A blade assembly includes a support frame, a cutting blade, a motor to drive the cutting blade, a support shaft operatively coupled to the support frame to permit pivotal movement of the support frame, and an actuator operatively coupled to the support frame to reciprocally move the slicing assembly between an extended position and a retracted position. When the slicing assembly is in the extended position, a plane of the cutting blade is substantially co-planar with a cutting plane of the food product, and the cutting blade slices the food product. Conversely, when the slicing assembly is in the retracted position, the plane of the cutting blade is disposed at a predetermined angle away from the cutting plane of the food product, and the cutting blade does not contact the food product.

12 Claims, 15 Drawing Sheets

(51) Int. Cl.
*B26D 7/06* (2006.01)
*B26D 7/32* (2006.01)
*B26D 5/08* (2006.01)

(58) Field of Classification Search
CPC . B26D 5/08; B26D 5/086; B26D 5/12; B26D 5/14; B26D 5/16; B26D 5/18; B26D 1/28; B26D 7/0625; B26D 7/32
USPC ..... 83/563, 564, 932
See application file for complete search history.

(56) References Cited

U.S. PATENT DOCUMENTS

| | | | | |
|---|---|---|---|---|
| 5,241,887 | A * | 9/1993 | Wolff | B26D 1/20 83/248 |
| 7,270,039 | B2 | 9/2007 | Lindee et al. | |
| 2004/0035276 | A1 | 2/2004 | Weber | |
| 2007/0028742 | A1 * | 2/2007 | Mueller | B26D 7/2635 83/676 |
| 2011/0179922 | A1 | 7/2011 | Weber | |
| 2011/0265624 | A1 | 11/2011 | Pasek et al. | |
| 2015/0246458 | A1 | 9/2015 | Gahler et al. | |
| 2018/0092383 | A1 | 4/2018 | Fox et al. | |

FOREIGN PATENT DOCUMENTS

| | | | | |
|---|---|---|---|---|
| DE | 102016003938 | A1 * | 10/2017 | |
| EP | 0713753 | B1 | 5/2000 | |
| EP | 1046476 | A2 * | 10/2000 | B26D 5/02 |

OTHER PUBLICATIONS

International Search Report and Written Opinion received for PCT/US20/18235 dated May 13, 2020, 12 pages.

* cited by examiner

PIVOTING BLADE ASSEMBLY FOR HIGH-SPEED FOOD SLICING MACHINE

RELATED APPLICATIONS

This patent application claims the benefit of U.S. Provisional Patent Application No. 62/809,066 filed on Feb. 22, 2019, the entire contents of which are incorporated by reference in its entirety.

FIELD OF THE DISCLOSURE

This disclosure relates to systems for extending and retracting cutting mechanisms of high-speed food slicing machines.

BACKGROUND

Food processing machines may utilize various food processing devices to process food products. For instance, some food processing machines utilize rotating cutting members to slice food products. Other food processing machines utilize varying food processing devices to form, mold, cut, package, or process food products in various ways. It can be advantageous to move the food processing devices towards or away from the food products to accomplish the desired objective.

In some food slicing systems, a rotating blade slices multiple slices of a food product or "food log." There is usually a dwell time or period of time that the food product is not advanced toward the blade for slicing, which may occur between production of separate stacks of the food slices. This permits the produced food stack to move further along a conveyor belt before production of the next food stack begins.

The blade continues to spin during the dwell time, but is not supposed to produce additional slices. However, because the food product often is soft or has water added, it does not act as a rigid solid mass, and may bulge slightly or flow, however minutely, as it rests on the conveyor belt. Such slight bulging or flowing causes the food product to nonetheless contact the spinning blade, which produces a small quantity of food product or "shrapnel" in the form of food particles, unwanted scrap, and other small pieces of food product. This is not only unhygienic and requires additional cleaning of the machine, such accumulation of food product tends to unduly clog various mechanical linkages and mechanisms, and also represents a loss of food product and an unnecessary expense.

Some systems have attempted to compensate for shrapnel and scrap production during the dwell time by linearly moving the blade away the food product during the dwell time. Some systems retract the food product away from the blade using a rear gripper. Other systems retract the blade away from the food product in a parallel or linear manner using rails, spindles, or other guide mechanisms. Once such system directed to linear retraction is described in a first embodiment described below with respect to FIGS. 1-9, which show that a blade assembly is moved in a linear path away from the food product. However, this requires a complex structural arrangement and is expensive to manufacture and difficult to maintain. A food slicing machine is needed to overcome one or more of the problems described above.

SUMMARY

In one embodiment, a food processing system is disclosed. The food processing system includes an input conveyor configured to transport a food product for slicing, a slicing assembly configured to slice the food product into a plurality of slices, and an output conveyor configured to receive thereon, the sliced food product. The slicing assembly is located at a downstream position relative to the input conveyor, and is supported by a pair of outwardly extending support arms. Further, the slicing assembly includes a support frame, a cutting blade, a motor configured to operatively drive the cutting blade, a support shaft coupled between the support arms and operatively connected to the support frame, and an actuator operatively coupled to the support frame of the slicing assembly.

The actuator is configured to reciprocally move the slicing assembly between an extended position and a retracted position, where the slicing assembly may pivot about or with the support shaft during the reciprocal movement. When the slicing assembly is in the extended position, a plane of the cutting blade is substantially co-planar with a cutting plane of the food product, and the cutting blade slices the food product. Conversely, when the slicing assembly is in the retracted position, the plane of the cutting blade is at a predetermined angle away from the cutting plane of the food product, and the cutting blade does not contact the food product.

In another embodiment, a pivoting blade assembly for the food processing system is disclosed. The pivoting blade assembly includes a support frame, a cutting blade configured to slice a food product into a plurality of food slices, a motor configured to operatively drive the cutting blade, a support shaft operatively coupled to the support frame and configured to permit pivotal movement of the support frame, and an actuator operatively coupled to the support frame of the slicing assembly, and configured to reciprocally move the slicing assembly between an extended position and a retracted position, where the slicing assembly may pivot about or with the support shaft during the reciprocal movement. When the slicing assembly is in the extended position, a plane of the cutting blade is substantially co-planar with a cutting plane of the food product, and the cutting blade slices the food product. Conversely, when the slicing assembly is in the retracted position, the plane of the cutting blade is disposed at a predetermined angle away from the cutting plane of the food product, and the cutting blade does not contact the food product.

BRIEF DESCRIPTION OF THE DRAWINGS

The disclosure can be better understood with reference to the following drawings and description. The components in the figures are not necessarily to scale, emphasis instead being placed upon illustrating the principles of the embodiments. Various exemplary embodiments of the subject matter disclosed herein are illustrated in the accompanying drawings in which like reference numerals represent like parts throughout, and in which.

DETAILED DESCRIPTION

The various features and advantageous details of the subject matter disclosed herein are explained more fully with reference to the non-limiting embodiments described in detail in the following description.

Figure 1:
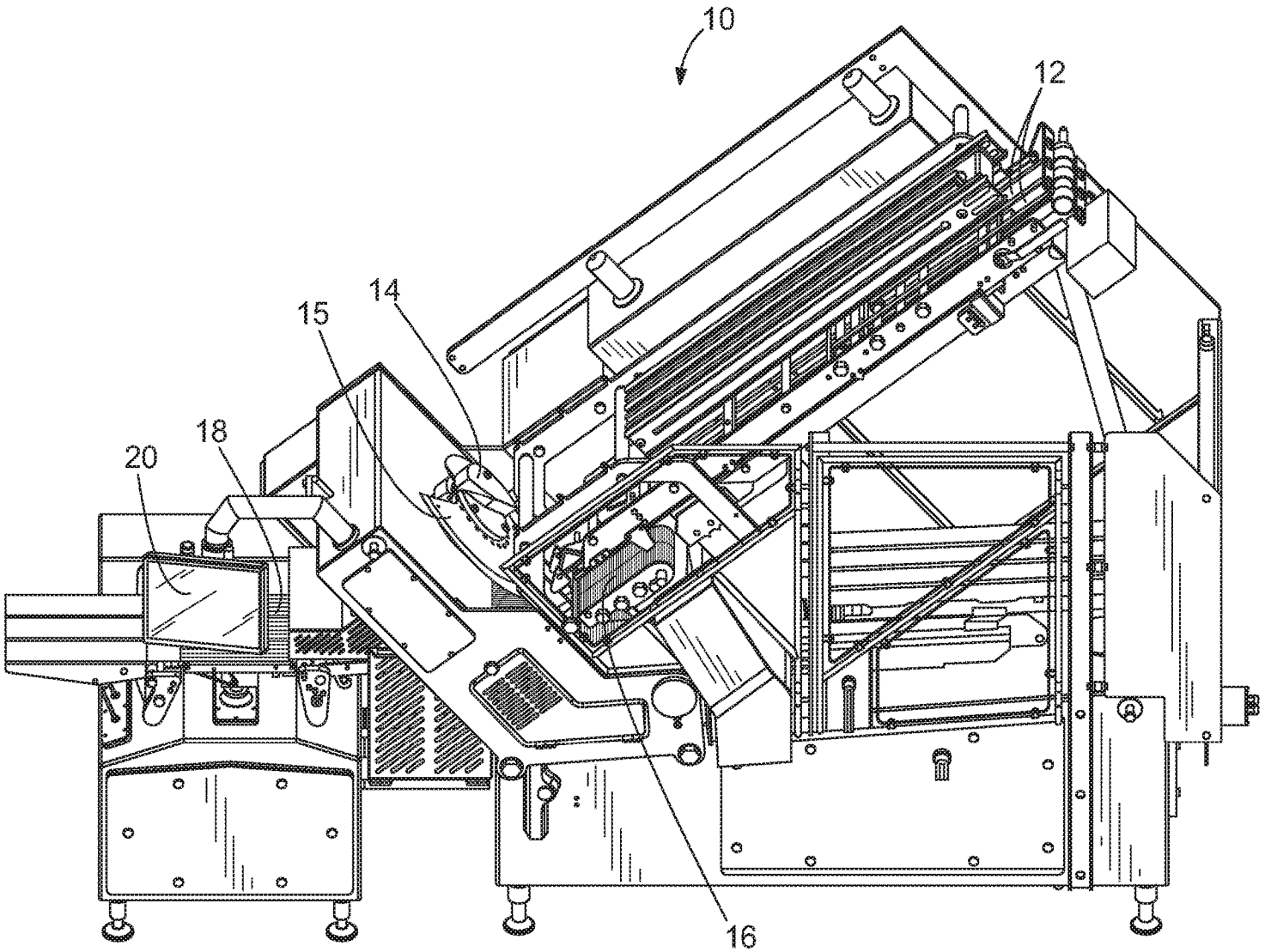
FIG. 1 illustrates a perspective view of a first main embodiment of a food processing system for processing food products, according to a first embodiment.

FIG. 1 illustrates a perspective view of one embodiment of a food processing system 10 for processing food products. The food processing system 10 includes a track or input conveyor 12 configured to transport the food product, a slicing apparatus or assembly 14, an auxiliary input conveyor 16, and a control system 20. Food product is loaded on to the track 12, which delivers it to the auxiliary input conveyor 16, which in turn, feeds the food product to the slicing apparatus 14. The slicing apparatus 14 includes a cutting member 15, which slices the food product. In other embodiments, the slicing apparatus 14 may vary. An output conveyor 18 then carries the sliced food product away from the food processing system 10. The control system 20 controls operation of the food processing system 10. In other embodiments, the food processing system 10 may vary.

Figure 2:
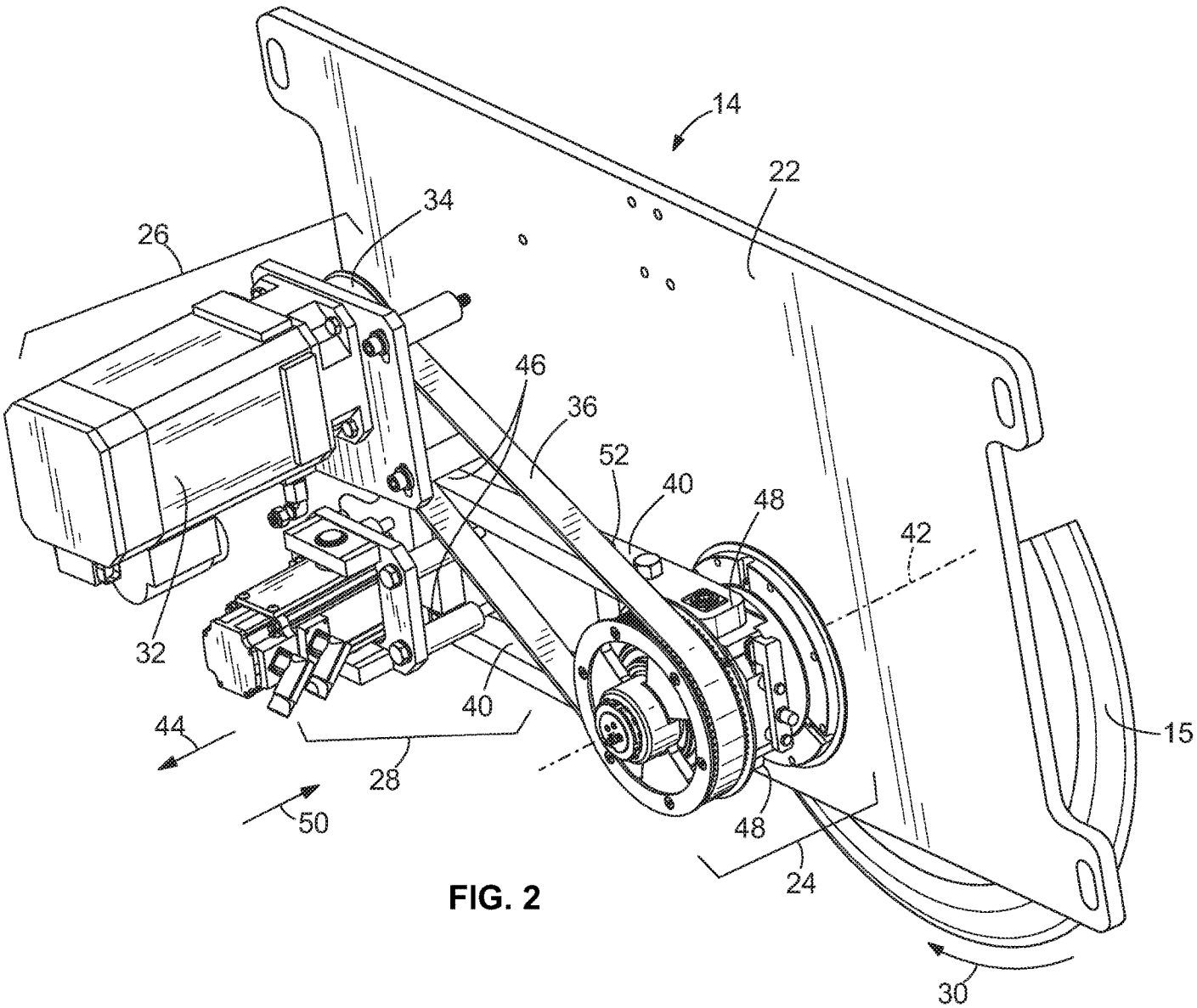
FIG. 2 illustrates a perspective view of an apparatus, and a mounting plate to which the apparatus is attached, removed from the food processing system of the embodiment of FIG. 1.
Figure 3:
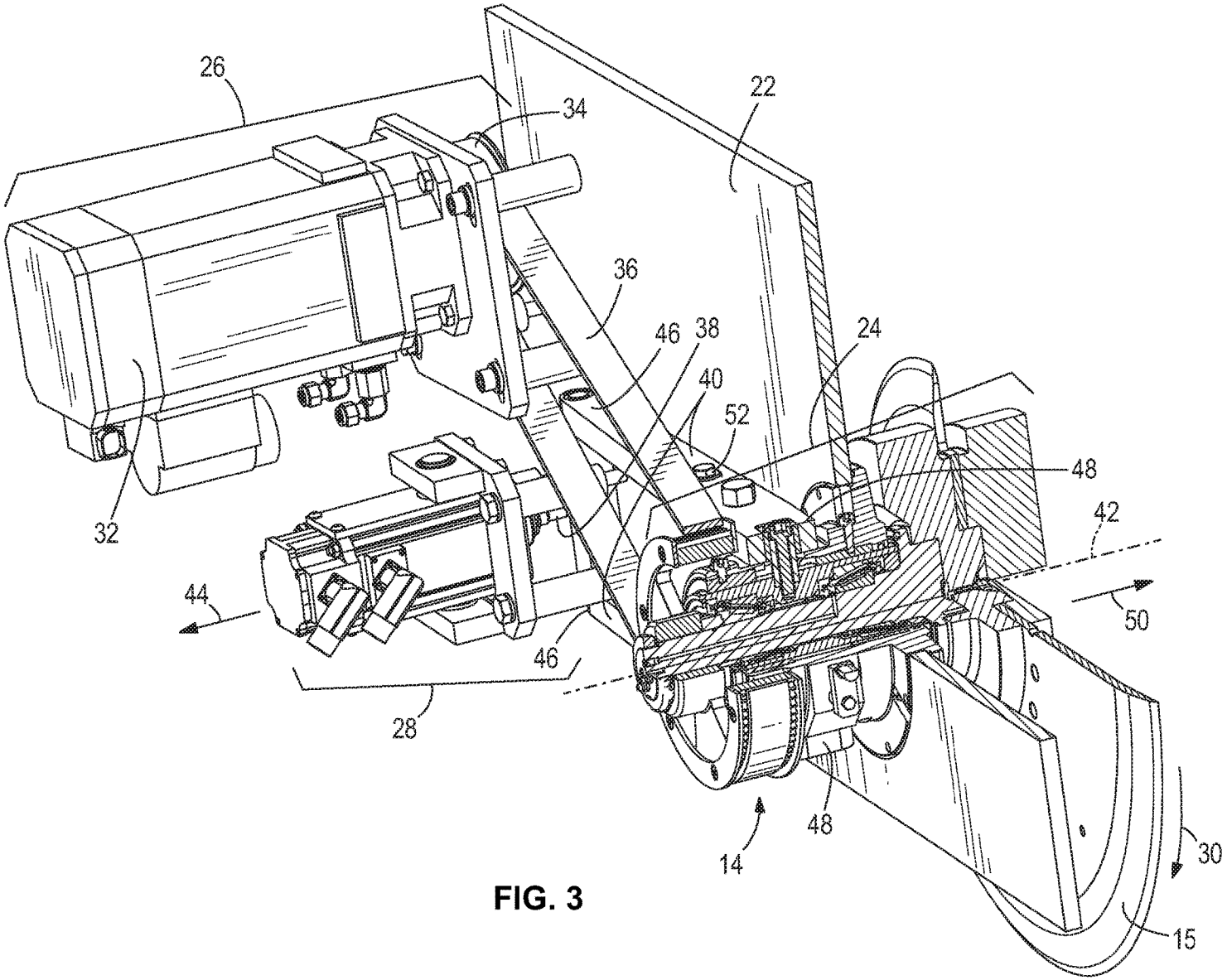
FIG. 3 illustrates the same perspective view of FIG. 2 with a portion of the mounting plate and a portion of a driven system removed to illustrate inner components.
Figure 4:
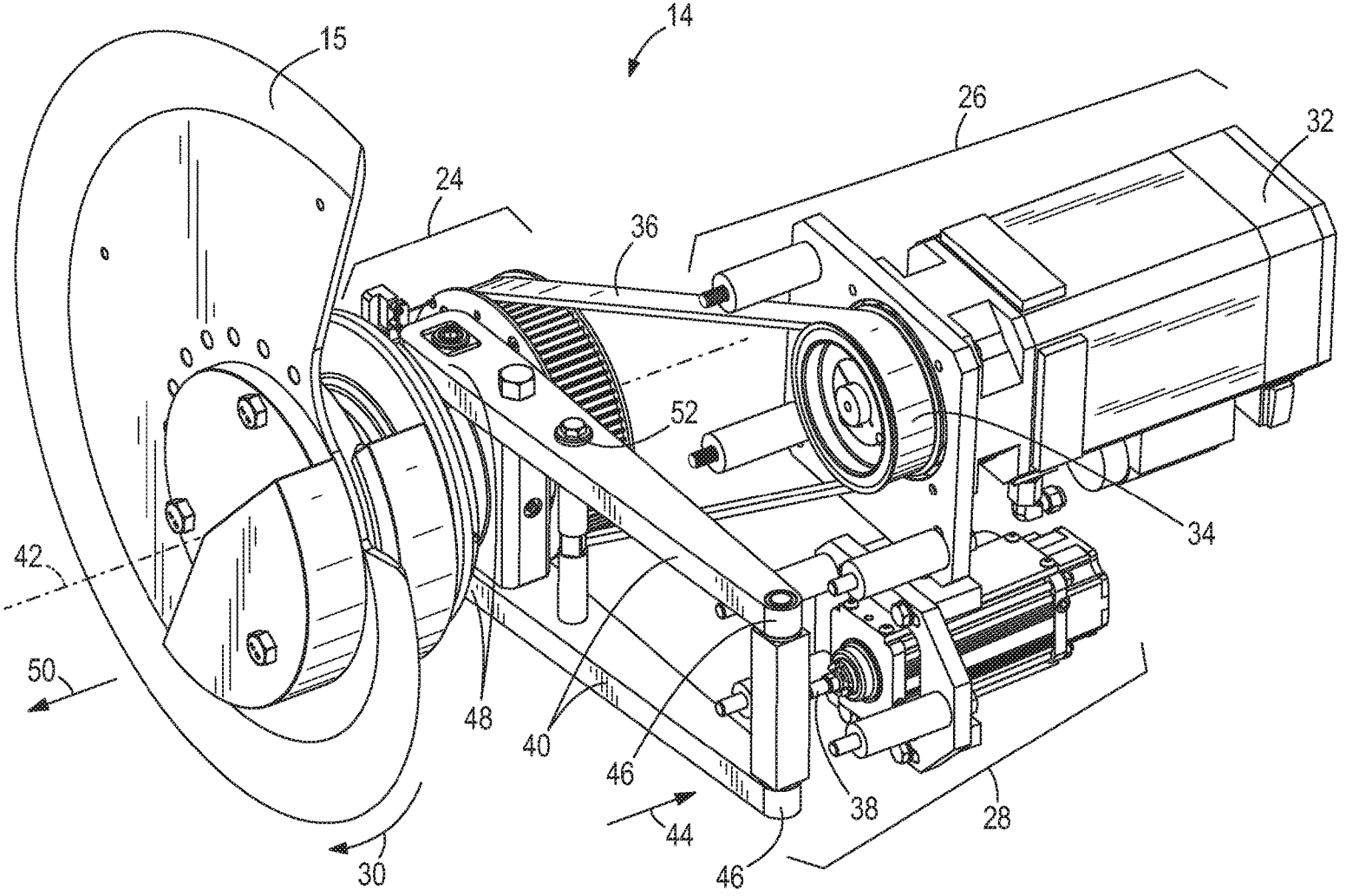
FIG. 4 illustrates an opposite side perspective view as FIG. 2 with the mounting plate removed.

FIG. 2 illustrates a perspective view of the apparatus 14, and a mounting plate 22 to which the apparatus 14 is attached, removed from the food processing system 10 of the embodiment of FIG. 1. FIG. 3 illustrates the same perspective view of FIG. 2 with a portion of the mounting plate 22 and a portion of a driven system 24 removed to illustrate inner components. FIG. 4 illustrates an opposite side perspective view as FIG. 2 with the mounting plate 22 removed.

As shown collectively in FIGS. 2-4, the apparatus 14 includes the cutting member 15, the driven system 24, a driving system 26, and an actuator system 28. The driving system 26 selectively rotates itself, the driven system 24, and the connected cutting member 15 in clockwise direction 30. The driving system 26 comprises a motor 32, a driving pulley 34, and a belt 36. The motor 32 selectively rotates the attached driving pulley 34, which correspondingly rotates the belt 36, which correspondingly rotates the driven system 24, which correspondingly rotates the cutting member 15 all in clockwise direction 30. In such manner, food product may be selectively sliced with the cutting member 15. In other embodiments, the driving system 26 may vary.

The actuator system 28 comprises an actuator shaft 38 (powered by a motor), and actuator arms 40. The actuator system 28 selectively moves the driven system 24 and the connected cutting member 15 between extended and retracted positions along axis 42. When the actuator shaft 38 moves the cutting member 15 in the extended position, the actuator shaft 38 moves in direction 44, thereby causing attached ends 46 of the attached actuator arms 40 to also move in direction 44. This causes ends 48 of the actuator arms 40 to move in direction 50 as a result of the actuator arms 40 pivoting at pivot point 52 which is pivotally attached to the housing of the food processing system 10 shown in FIG. 1.

The movement of the ends 48 of the actuator arms in direction 50 causes the attached driven system 24 to also move in direction 50. The movement of the attached driven system 24 in direction 50 causes the attached cutting member 15 to also move in direction 50. When the cutting member 15 is in the extended position, the cutting member 15 is disposed further away from the belt 36 than when the cutting member 15 is in the retracted position. When the cutting member 15 is in the extended position, the cutting member 15 is in position to slice food product.

When the actuator shaft 38 moves the cutting member 15 into the retracted position, the actuator shaft 38 moves in direction 50, thereby causing attached ends 46 of the attached actuator arms 40 to also move in direction 50. This causes ends 48 of the actuator arms 40 to move in direction 44 as a result of the actuator arms 40 pivoting at pivot point 52 which is pivotally attached to the housing of the food processing system 10 shown in FIG. 1.

The movement of the ends 48 of the actuator arms in direction 44 causes the attached driven system 24 to also move in direction 44. The movement of the attached driven system 24 in direction 44 causes the attached cutting member 15 to also move in direction 44. When the cutting member 15 is in the retracted position, the cutting member 15 no longer cuts the food product. As a result, the actuator system 28 is used to selectively cut food product by moving the cutting member 15 between the extended and retracted positions. In other embodiments, the actuator system 28 may vary.

Figure 5:
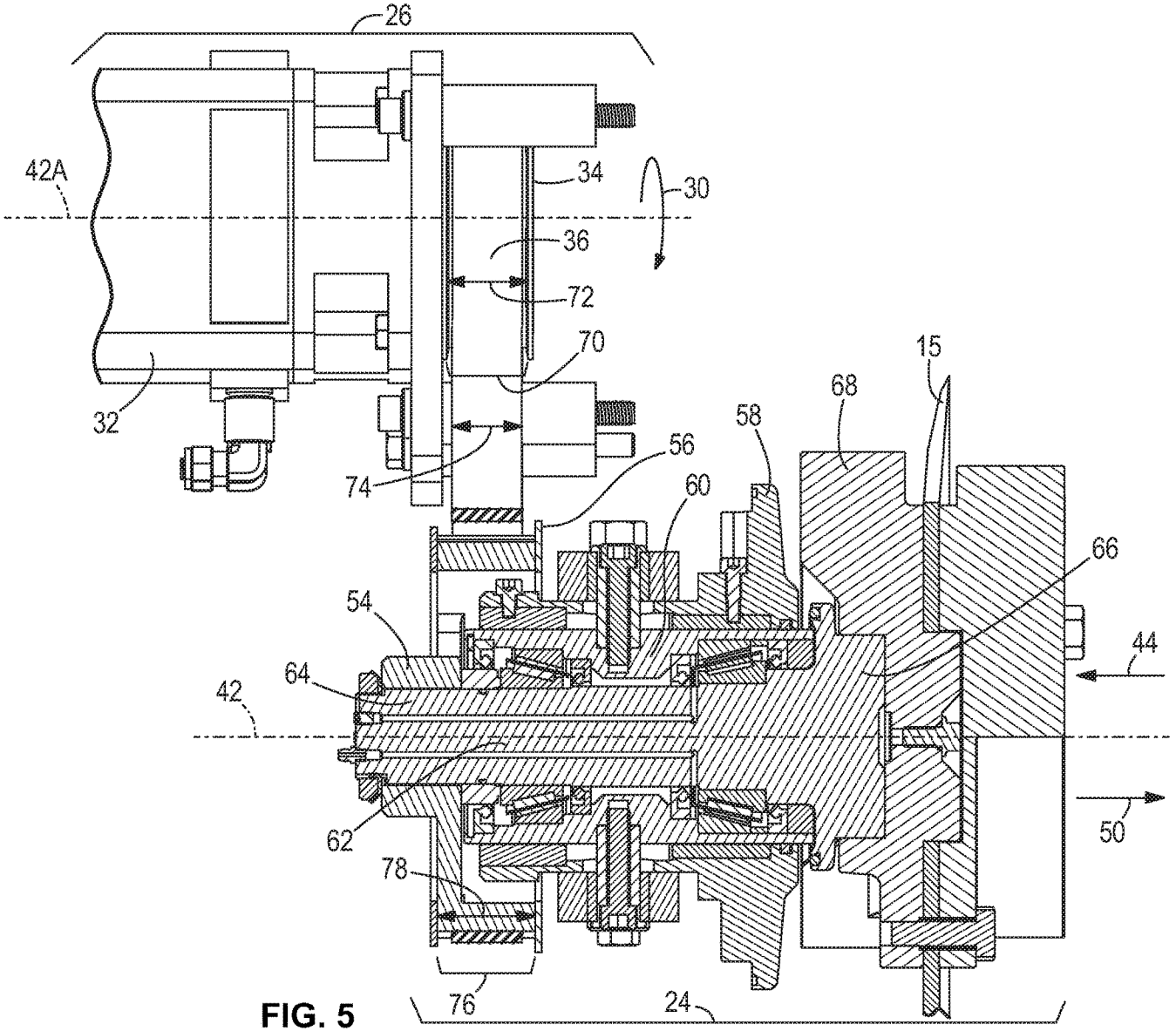
FIG. 5 illustrates a side view of a driving system, the driven system, and a cutting member of the embodiment of FIG. 4 with an interior of the driven system being exposed.

FIG. 5 illustrates a side view of the driving system 26, driven system 24, and cutting member 15 of the embodiment of FIG. 4 with an interior of the driven system 24 being exposed. As shown, the driven system 24 comprises a driven pulley hub 54, a driven pulley 56, a main housing 58, a spindle housing 60, and a spindle 62. The driven pulley hub 54 is fixedly attached to an end 64 of the spindle 62 and to the driven pulley 56. The other end 66 of the spindle 62 is fixedly attached to the cutting member 15. In other embodiments, the driven system 24 may vary.

Counter weights 68 are fixedly attached to the cutting member 15. When the motor 32 of the driving system 26 rotates the driving pulley 34 in clockwise direction 30, which correspondingly rotates the belt 36 in clockwise direction 30, the belt 36 correspondingly rotates the driven pulley 56 in clockwise direction 30. When the driven pulley 56 is rotated in clockwise direction 30, the fixedly attached pulley hub 54 and the spindle 62 also rotate in clockwise direction 30 with the spindle 62 rotating relative to and within the spindle housing 60.

The spindle housing 60 is fixedly attached to the main housing 58. As a result, the spindle 62 rotates in clockwise direction 30 relative to both the spindle housing 60 and the main housing 58. Rotation of the spindle 62 in clockwise direction 30 causes the fixedly attached cutting member 15 and counter weights 68 to also rotate in clockwise direction 30. In such manner, the driving system 26 can selectively cause the cutting member 15 to rotate in clockwise direction 30 to cut food product.

The driving pulley 34 comprises a driving pulley pocket 70 which the belt 36 is disposed against. A width 72 of the driving pulley pocket 70 is larger than a width 74 of the belt 36 to allow relative movement of the driving pulley 34 along axis 42A relative to the belt 36 as the actuator system 28 (discussed collectively in FIGS. 2-4) selectively moves the driven system 24 and the connected cutting member 15 between the extended and retracted positions. In such manner, the belt 36 is allowed to traverse back and forth along axis 42A relative to the driving pulley 34 during extension and retraction of the cutting member 15 to allow the longitudinal position of the cutting member 15 to be changed without damaging the belt 36.

The width 72 of the driving pulley pocket 70 is at least 1.3 times larger than the width 74 of the belt 36. In another embodiment, the width 72 of the driving pulley pocket 70 is at least 2 times larger than the width 74 of the belt 36. In still other embodiments, the width 72 of the driving pulley pocket 70 may vary as to how much larger it is than the width 74 of the belt 36.

Similarly, the driven pulley 56 comprises a driven pulley pocket 76 which the belt 36 is disposed against. A width 78 of the driven pulley pocket 76 is larger than the width 74 of the belt 36 to allow relative movement of the driven pulley 56 along axis 42 relative to the belt 36 as the actuator system 28 (discussed collectively in FIGS. 2-4) selectively moves the driven system 24 and the connected cutting member 15 between the extended and retracted positions.

In such manner, the belt 36 is allowed to walk back and forth relative to the driven pulley 56 along axis 42 during extension and retraction of the cutting member 15 to allow the longitudinal position of the cutting member 15 to be changed without damaging the belt 36. The width 78 of the driven pulley pocket 76 is at least 1.2 times larger than the width 74 of the belt 36 to allow relative movement between the belt 36 and the driven pulley pocket 76 to avoid damage to the belt.

This multiplier of at least 1.2 has been found to be a critical dimension with unexpected results due to the reduction and/or complete elimination of belt damage occurring at this critical dimension. In another embodiment, the width 78 of the driven pulley pocket 76 is at least 2 times larger than the width 74 of the belt 36. In still other embodiments, the width 78 of the driven pulley pocket 76 may vary as to how much larger it is than the width 74 of the belt 36.

Figure 6:
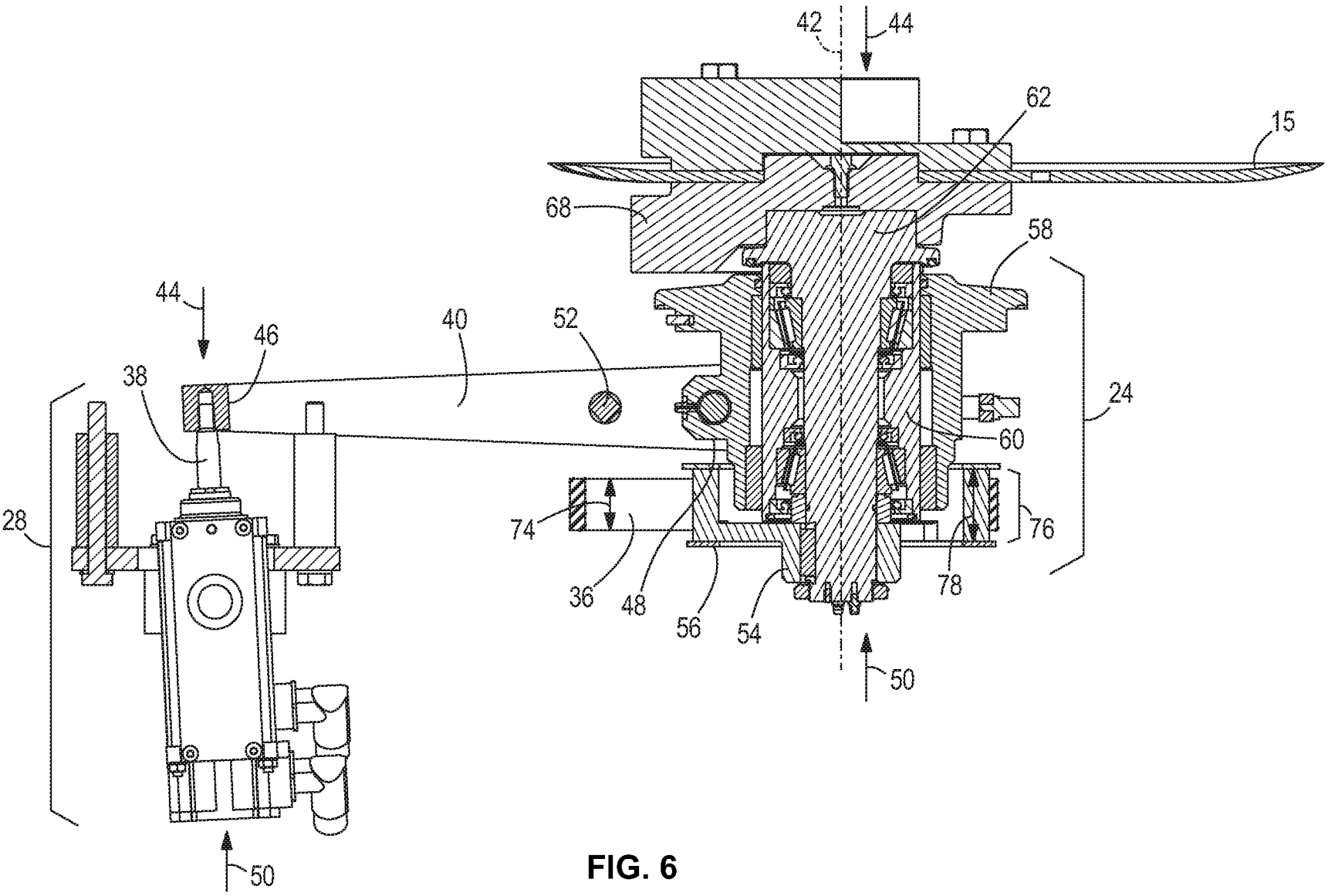
FIG. 6 illustrates a side view of an actuator system, the driven system, and the cutting member of the embodiment of FIG. 4 with an interior of the driven system being exposed.
Figure 7:
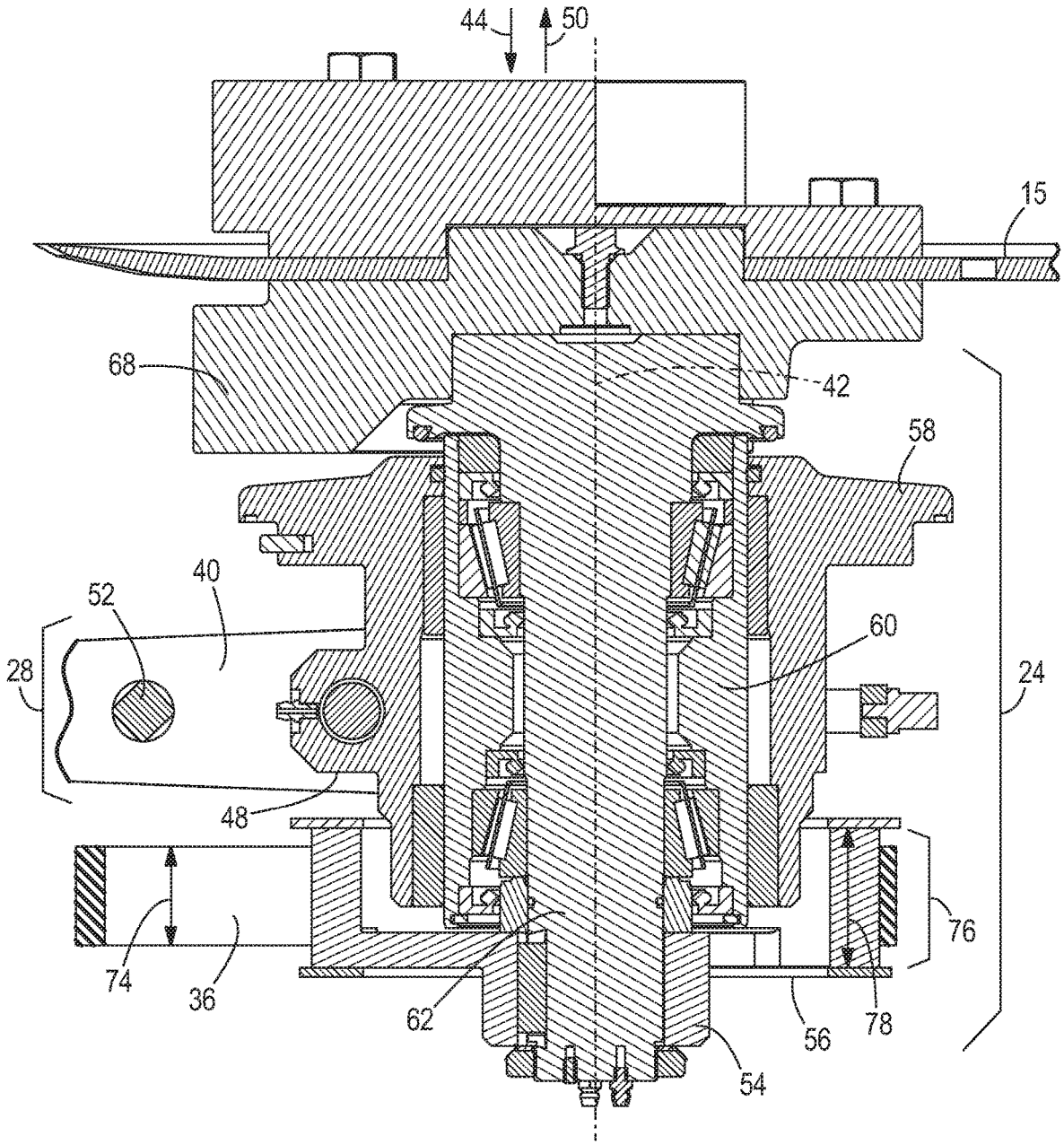
FIG. 7 illustrates an expanded view of the interior of the driven system of the embodiment of FIG. 6.

FIG. 6 illustrates a side view of the actuator system 28, driven system 24, and cutting member 15 of the embodiment of FIG. 4 with an interior of the driven system 24 being exposed. FIG. 7 illustrates a close-up view of the interior of the driven system 24 of the embodiment of FIG. 6. As shown in FIGS. 6 and 7 collectively, the actuator system 28 selectively moves the driven system 24 and the connected cutting member 15 between extended and retracted positions along axis 42.

As previously discussed, when the actuator shaft 38 moves the cutting member 15 in the extended position, the actuator shaft 38 moves in direction 44, thereby causing attached ends 46 of the attached actuator arms 40 to also move in direction 44. This causes ends 48 of the actuator arms 40 to move in direction 50 as a result of the actuator arms 40 pivoting at pivot point 52 which is pivotally attached to the housing of the food processing system 10 shown in FIG. 1.

Ends 48 of the actuator arms 40 are attached to the main housing 58. The movement of the ends 48 of the actuator arms in direction 50 causes the attached main housing 58 to also move in direction 50. Movement of the main housing 58 in direction 50 causes the attached spindle housing 60, driven pulley hub 54, driven pulley 56, spindle 62, cutting member 15, and counter weights 68 to also move in direction 50.

Due to the width 78 of the driven pulley pocket 76 being larger than the width 74 of the belt 36, the belt 36 is allowed to walk relative to the driven pulley 56 along axis 42 during the extension of the cutting member 15 in direction 50 to allow the longitudinal position of the cutting member 15 to be changed without damaging the belt 36. Similarly, as shown in FIG. 5, due to the width 72 of the driving pulley pocket 70 being larger than the width 74 of the belt 36, the belt 36 is allowed to walk relative to the driving pulley 34 along axis 42A during the extension of the cutting member 15 in direction 50 to allow the longitudinal position of the cutting member 15 to be changed without damaging the belt 36.

When the cutting member 15 is in the extended position, the cutting member 15 is disposed further away from the belt 36 than when the cutting member 15 is in the retracted position. When the cutting member 15 is in the extended position, the cutting member 15 is in position to slice food product.

As previously discussed, as shown in FIGS. 6 and 7 collectively, when the actuator shaft 38 moves the cutting member 15 into the retracted position, the actuator shaft 38 moves in direction 50, thereby causing attached ends 46 of the attached actuator arms 40 to also move in direction 50. This causes ends 48 of the actuator arms 40 to move in direction 44 as a result of the actuator arms 40 pivoting at pivot point 52 which is pivotally attached to the housing of the food processing system 10 shown in FIG. 1. The movement of the ends 48 of the actuator arms in direction 44 causes the attached main housing 58 to also move in direction 44. Movement of the main housing 58 in direction 44 causes the attached spindle housing 60, driven pulley hub 54, driven pulley 56, spindle 62, cutting member 15, and counter weights 68 to also move in direction 44.

Due to the width 78 of the driven pulley pocket 76 being larger than the width 74 of the belt 36, the belt 36 is allowed to walk relative to the driven pulley 56 along axis 42 during the retraction of the cutting member 15 in direction 44 to allow the longitudinal position of the cutting member 15 to be changed without damaging the belt 36. Similarly, as illustrated in FIG. 5, due to the width 72 of the driving pulley pocket 70 being larger than the width 74 of the belt 36, the belt 36 is allowed to walk relative to the driving pulley 34 along axis 42A during the retraction of the cutting member 15 in direction 44 to allow the longitudinal position of the cutting member 15 to be changed without damaging the belt 36.

When the cutting member 15 is in the retracted position, the cutting member 15 no longer cuts the food product. As a result, the actuator system 28 shown in FIGS. 6-7 is used to selectively cut food product by moving the cutting member 15 between the extended and retracted positions.

Figure 8:
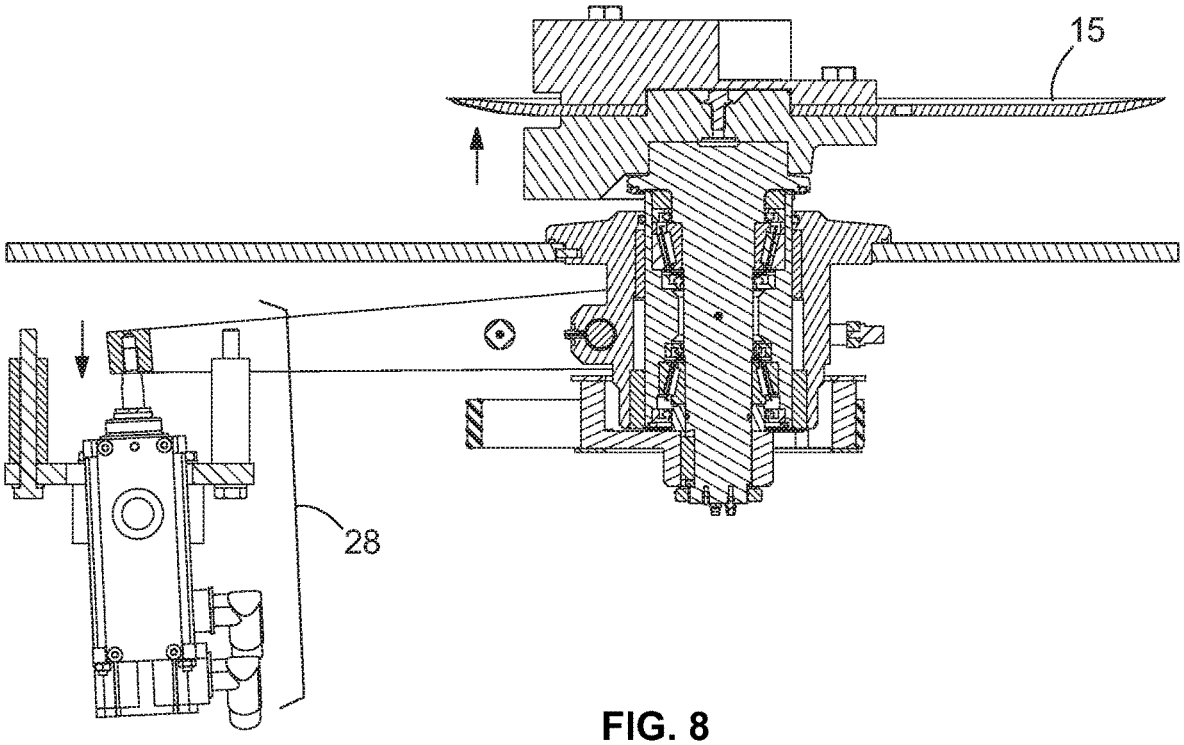
FIG. 8 illustrates the side view of the embodiment of FIG. 6 with the cutting member having been moved into an extended position by the actuator system.

FIG. 8 illustrates the side view of the embodiment of FIG. 6 with the cutting member 15 having been moved into the extended position by the actuator system 28.

Figure 9:
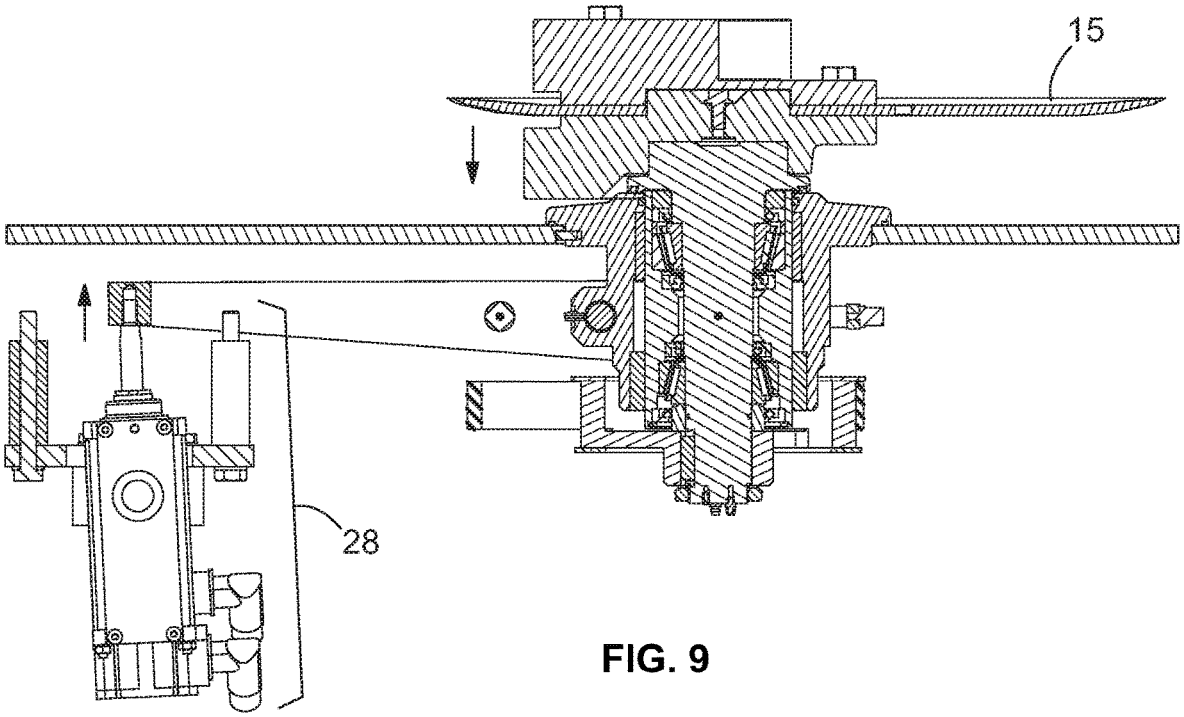
FIG. 9 illustrates the side view of the embodiment of FIG. 6 with the cutting member having been moved into a retracted position by the actuator system.

FIG. 9 illustrates the side view of the embodiment of FIG. 6 with the cutting member 15 having been moved into the retracted position by the actuator system 28.

Figure 10:
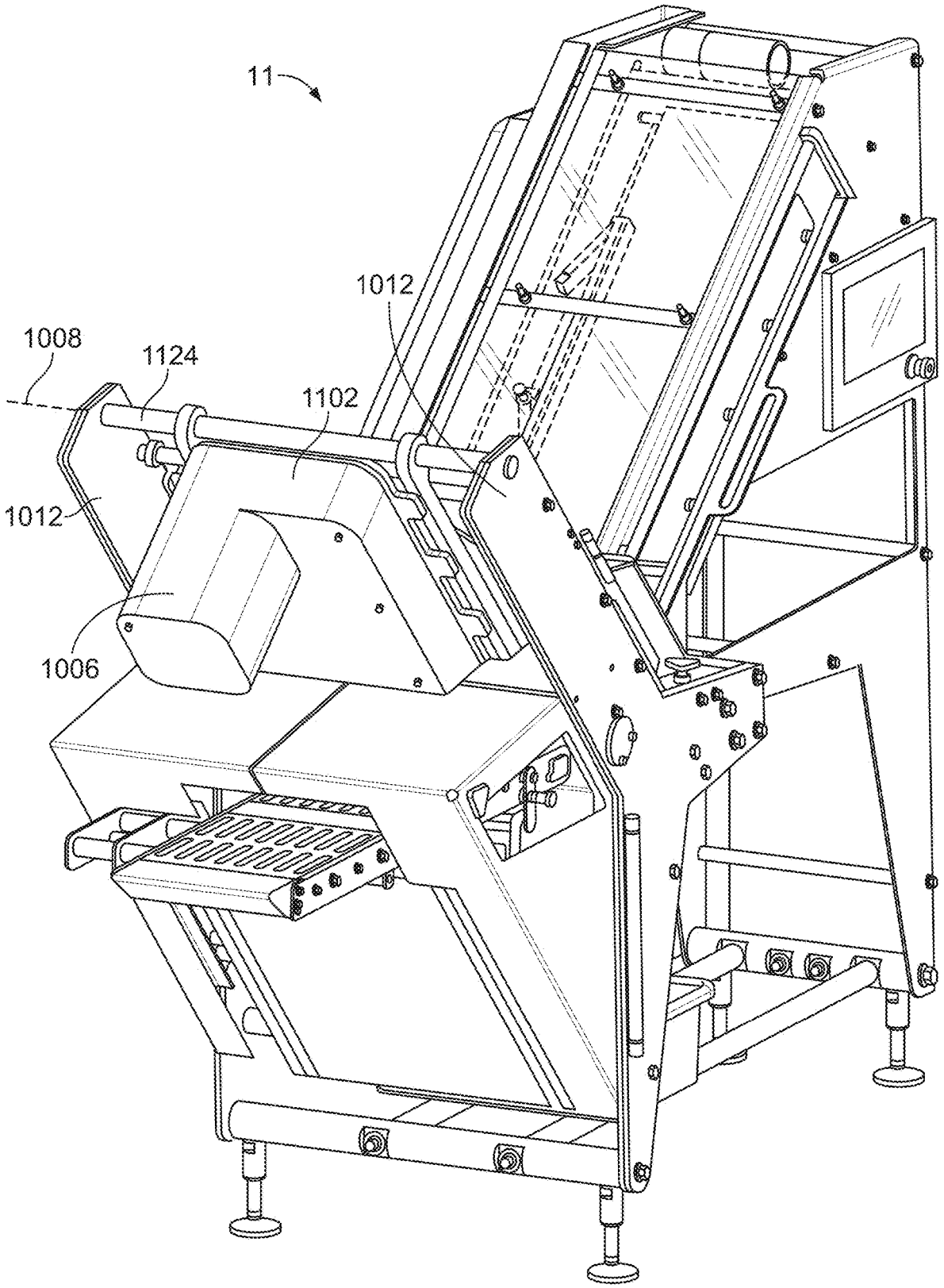
FIG. 10 show a perspective view of second main embodiment of a high-speed food-slicing machine, showing a pivoting blade assembly.

FIG. 10 illustrates a second main embodiment of the food processing system 11 of FIG. 1. In the embodiment of FIGS. 10-17, the food processing system 11 includes a pivoting blade assembly 1006 rather than the blade apparatus 14 shown in the first main embodiment of FIGS. 1-9. The pivoting blade assembly 1006 is similar in some respects to the apparatus or blade apparatus 14 of FIGS. 1-9 in that it may include some similar components, such as a blade or cutting member 15, a motor 32, and a drive belt 36 operatively coupled between the motor 32 and the blade 15. Preferably, the motor 32 is an electric servomotor, but any suitable motor may be used.

Note that in the second main embodiment of FIGS. 10-17, the entire blade assembly 1006 pivots about an axis in an arcuate path between an extended position, where the blade 15 is capable of slicing the food product, and a retracted position, where the blade 15 does not contact the food product, and where a gap exists therebetween.

Referring to FIG. 10, the pivoting blade assembly 1006 may pivot about an axis 1008 extending between two parallel support members or extended arms 1012 of the food processing system 11. In contrast, the blade apparatus 14 of the embodiments illustrated in FIGS. 1-9 does not pivot at all, but rather, moves in a linear fashion so that as the blade apparatus 14 of those figures moves between the retracted and extended position, and remains in a parallel orientation relative the food product and the cutting plane of the food product. In other words, blade apparatus 14 of FIGS. 1-9 moves linearly, along a path that is essentially coaxial with the food product, and thus the plane of the blade forms a parallel gap between the blade and the food product, which changes in width as the blade assembly 14 moves linearly between the extended and retracted positions.

Referring now to FIGS. 11-14, FIG. 11 shows a side view of the pivoting blade assembly 1006, which may include a blade assembly housing or support frame 1102, a motor housing 1106 configured to protect and encompass the motor 32 (which motor housing 1106 may be part of or integrally formed with the blade assembly housing 1102, or affixed thereto), and right and left side housing support rails 1110 operatively coupled to (or integrally formed with) the blade assembly housing 1102 on opposite sides thereof (only one of which is visible in the Figures).

Also included is an actuator cylinder 1116, a cylinder piston or rod 1118 reciprocally driven by the actuator cylinder 1116, right and left side actuator linkages 1120 arranged on a driven reciprocating shaft 1122, and a support shaft 1124 about which or with the pivoting blade assembly 1006 may pivot or partially rotate during reciprocal movement between the extended position and the retracted position. The driven reciprocating shaft 1122 and the support shaft 1124 may be secured between the support arms 1012. The actuator cylinder 1116 may be secured to one of the support arms 1012 by a suitable bracket 1126, bolt, weld, or other known fastening structure.

In one embodiment, the support shaft 1124 may be fixed between the support arms 1012 without rotational ability, and the pivoting blade assembly 1006 may pivot about the support shaft 1124 during movement between the extended position and the retracted position. In another embodiment, the support shaft 1124 may pivot or rotate between the support arms 1012, and the pivoting blade assembly 1006 may be fixed to the support shaft 1124 during movement between the extended position and the retracted position.

Figure 11:
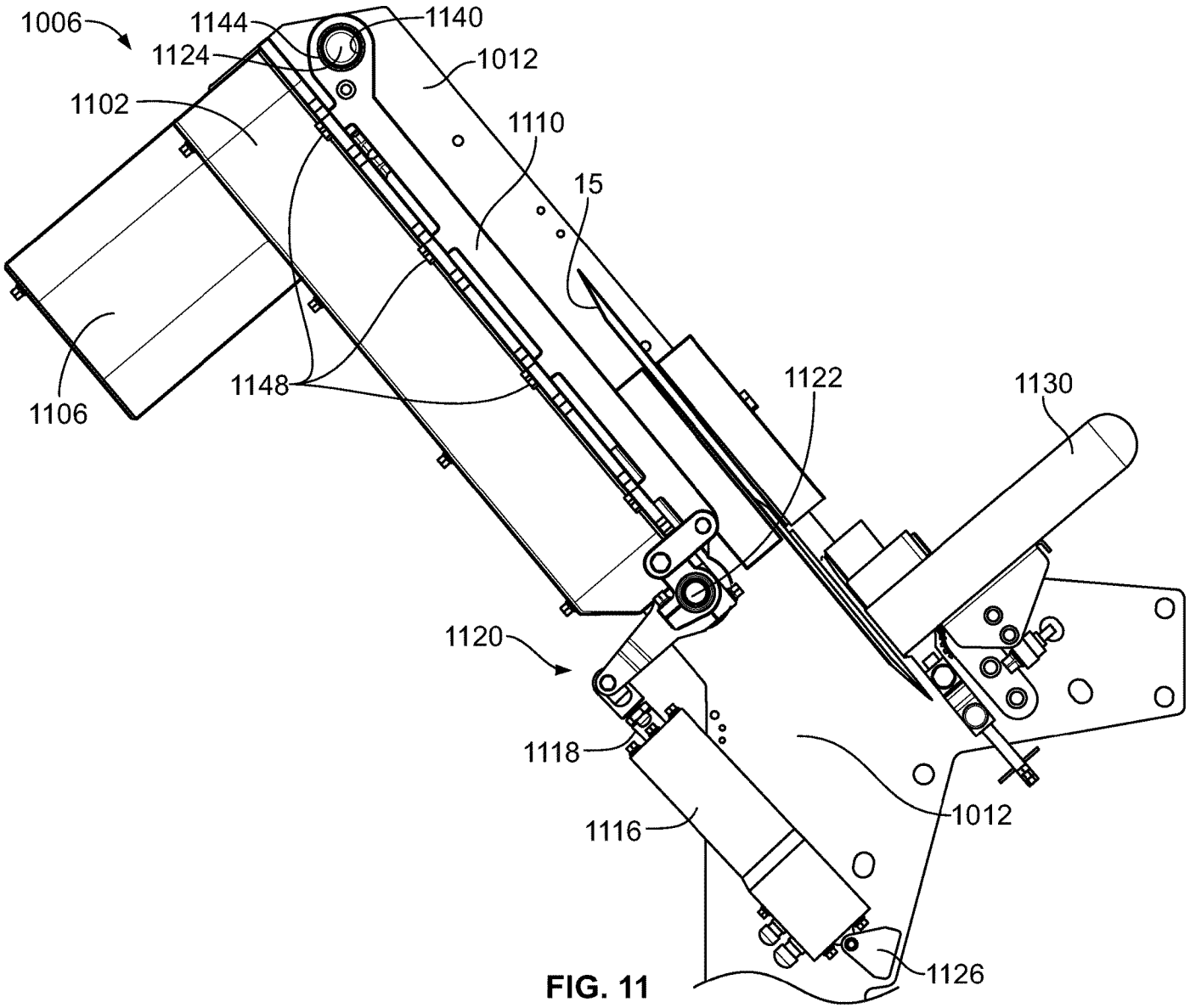
FIG. 11 is a side view of the pivoting blade assembly of the embodiment of FIG. 10.

In FIG. 11, the food product 1130 is shown positioned for slicing in the food processing machine 11. As described above, the motor 32 is configured to drive the cutting blade 15, and in some embodiments may operatively drive the blade 15 with a belt, timing belt, pulley, or other suitable mechanical arrangement or linkage. Alternately, the motor 32 may drive the blade 15 with a gearing arrangement, such as with a worm drive, gears, and the like. Any suitable mechanism may be used to operatively couple the motor 32 to the blade 15, including a direct drive connection. The motor 32 of FIGS. 1-9 may be similar or identical to a motor housed in the motor housing 1106 of FIGS. 10-17.

Figure 12:
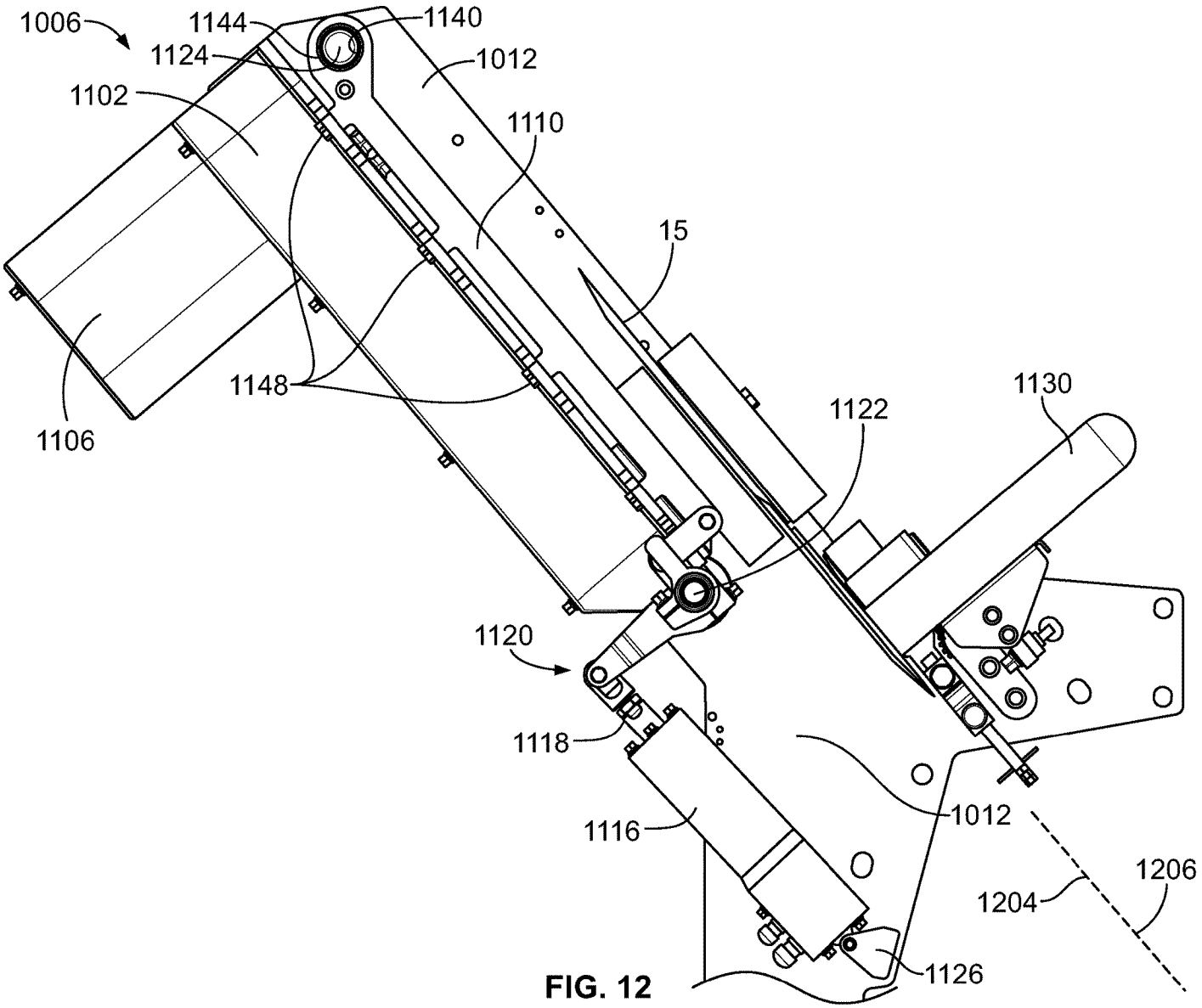
FIG. 12 is a side view of the pivoting blade assembly of the embodiment of FIG. 10 shown with the blade assembly in an extended position for cutting the food product.
Figure 13:
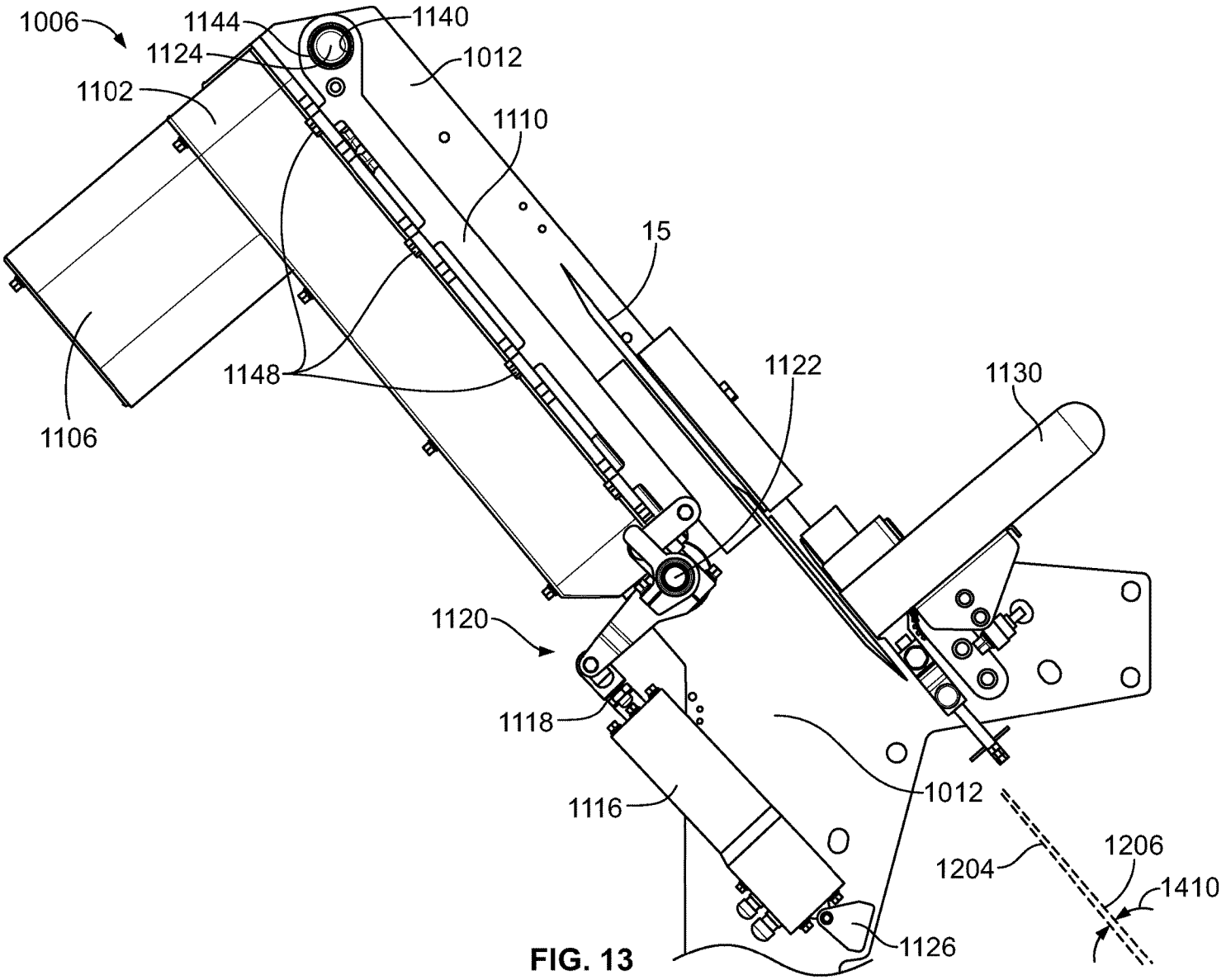
FIG. 13 is a side view of the pivoting blade assembly of the embodiment of FIG. 10 shown with the blade assembly in a retracted position so that the blade is not in contact with the food product.
Figure 14:
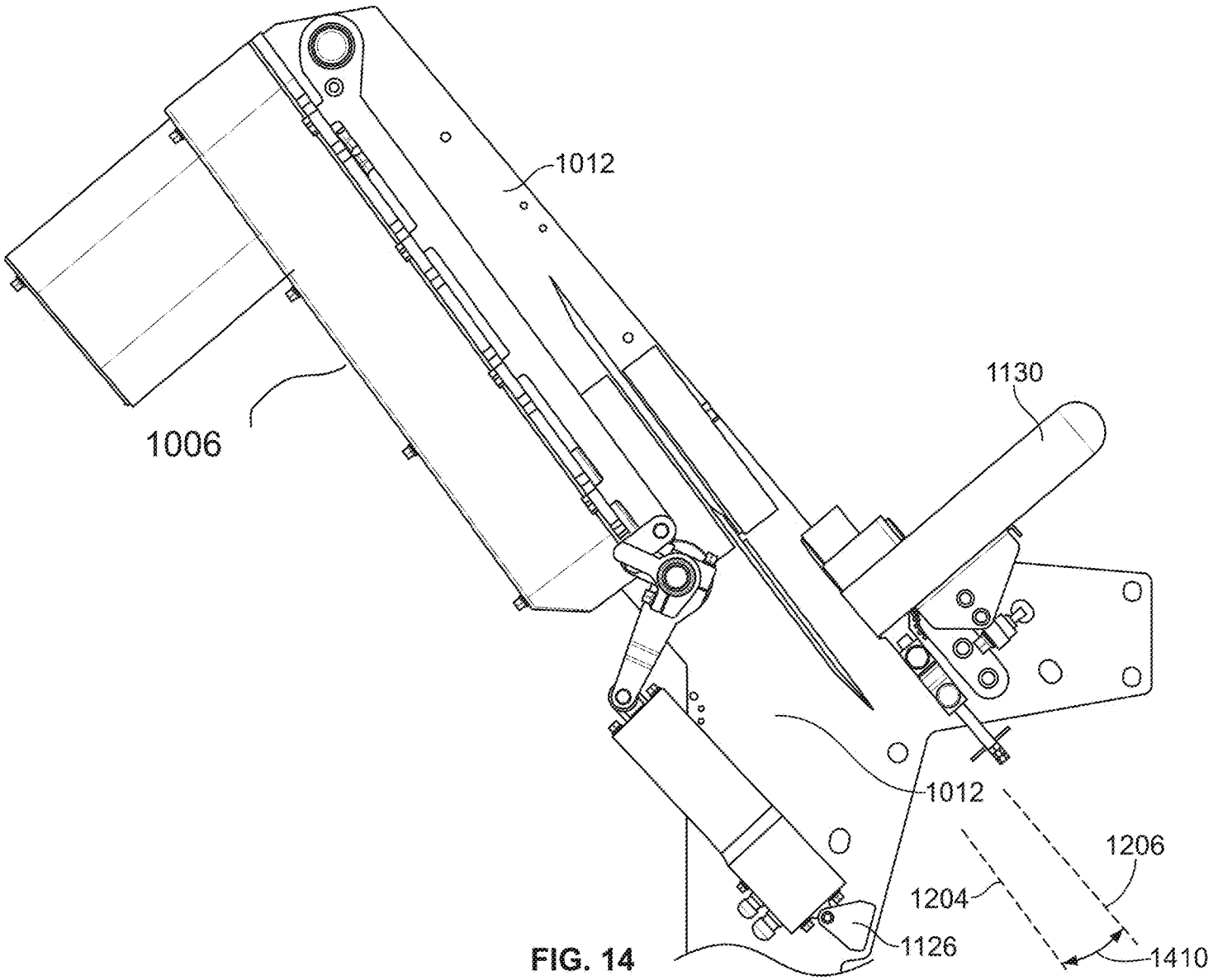
FIG. 14 is an enlarged side view of FIG. 13.

FIG. 12 shows a side view of the pivoting blade assembly 1006 with the blade 15 in the extended position and ready to contact the food product 1130 for slicing. Conversely, FIG. 13 shows a side view of the pivoting blade assembly 1006 with the blade 15 in the retracted position and away from the food product 1130. FIG. 14 shows an enlarged and overly exaggerated view of the blade 15 relative to the food product 1130 in the retracted position of FIG. 14, particularly illustrating the exaggerated angle between the face of the blade 15 and the food product 1130. Note that for clarity, the angle is not drawn to scale and is greatly exaggerated for purposes of illustration only.

As shown in FIGS. 10-14, the support shaft 1124 extends laterally between the parallel support arms 1012. Any suitable arrangement of the support arms 1012 may be used that have the required structural strength and rigidity to support the pivoting blade assembly 1006. The pivoting support shaft 1124 may be received within corresponding apertures 1140 of the left and right side housing support rails 1110, and in the embodiments that permit the blade assembly 1006 to pivot relative to a fixed support shaft 1124, a race bearing 1144 or other bearing or support pin arrangement may be included to effect smooth reciprocal rotation of the pivoting blade assembly 1106.

The housing support rails 1110 preferably extend along a length of the blade assembly housing or frame 1102, and may be attached to the blade assembly housing 1102 using rail bolts 1148. However, any suitable means may be used to attach the housing support rails 1110 to the blade assembly housing or frame 1102, such as by welds, mechanical fasteners and the like, or in some embodiments, the housing support rails 1110 may be integrally formed with the blade assembly housing 1102.

As described above, FIG. 12 shows the pivoting blade assembly 1006 in the extended position where a plane of the cutting blade 1204 is co-planar with a cutting plane 1206 of the food product 1130. In this extended position, the cutting blade 15 may slice the food product 1130 as the food product 1130 is fed toward the cutting blade. As described above, the plane of the cutting blade 1204 is substantially co-planar with the cutting plane 1206 of the food product 1130. However, in some embodiments, a small negative angle may be induced between the plane of the cutting blade 1204 and cutting plane 1206 of the food product. In other words, the pivoting blade assembly 1006, and hence the blade 15, may be slightly angled into the food product 1130 to compensate for blade wear. Such a maximum negative angle is preferably no greater than −2.30 degrees, with a typical negative angle between −0.50 degrees and −2.30 degrees if blade wear compensation is used.

FIGS. 13-14 show the pivoting blade assembly 1006 in the retracted position where the plane of the cutting blade 1204 is disposed at a predetermined angle 1410 away from the cutting plane 1206 of the food product 1130. In this position, the cutting blade 15 does not contact the food product 1130. The predetermined angle 1410 is preferably about 5.6 degrees, but may vary between 4 degrees and 8 degrees. In some embodiments, the predetermined angle 1410 may vary between 2 degrees and 10 degrees.

As described above and shown in FIGS. 11-15, the actuator cylinder 1116 may be operatively coupled to the blade assembly housing or support frame 1102 at one end, where such operative coupling may be accomplished via left and right side linkages 1120, which preferably may be identical. Preferably, the actuator cylinder 1116 is a linear electric servomotor. However, any suitable actuator may be used, such as a pneumatic actuator, a hydraulic actuator, a servomotor, or a stepper motor, as long as the required precise movements at rated speed can be performed.

Figure 15:
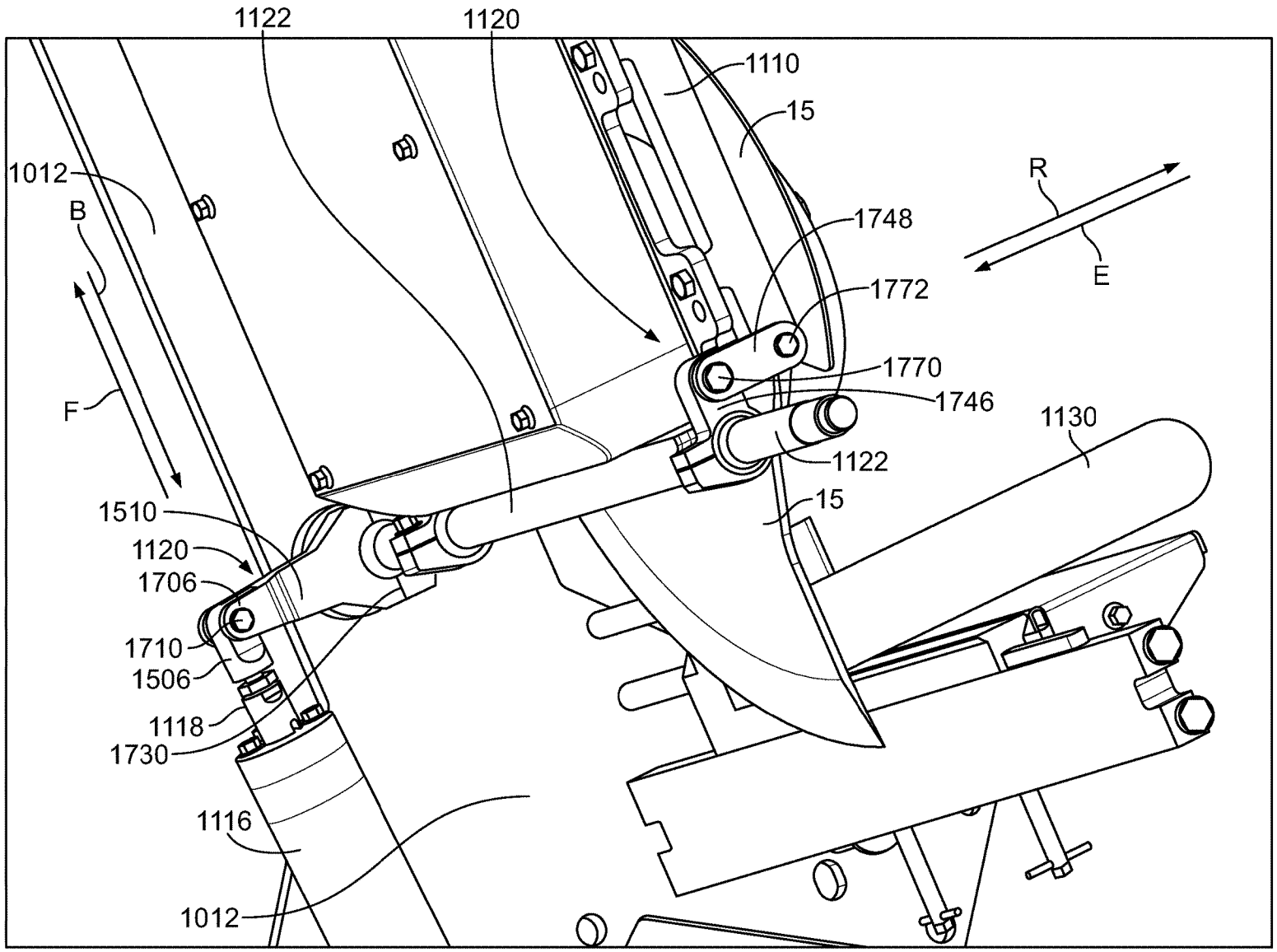
FIG. 15 is a rear perspective view of the blade assembly, particularly showing an actuator, a connecting arm, and the pivoting mechanism.
Figure 16:
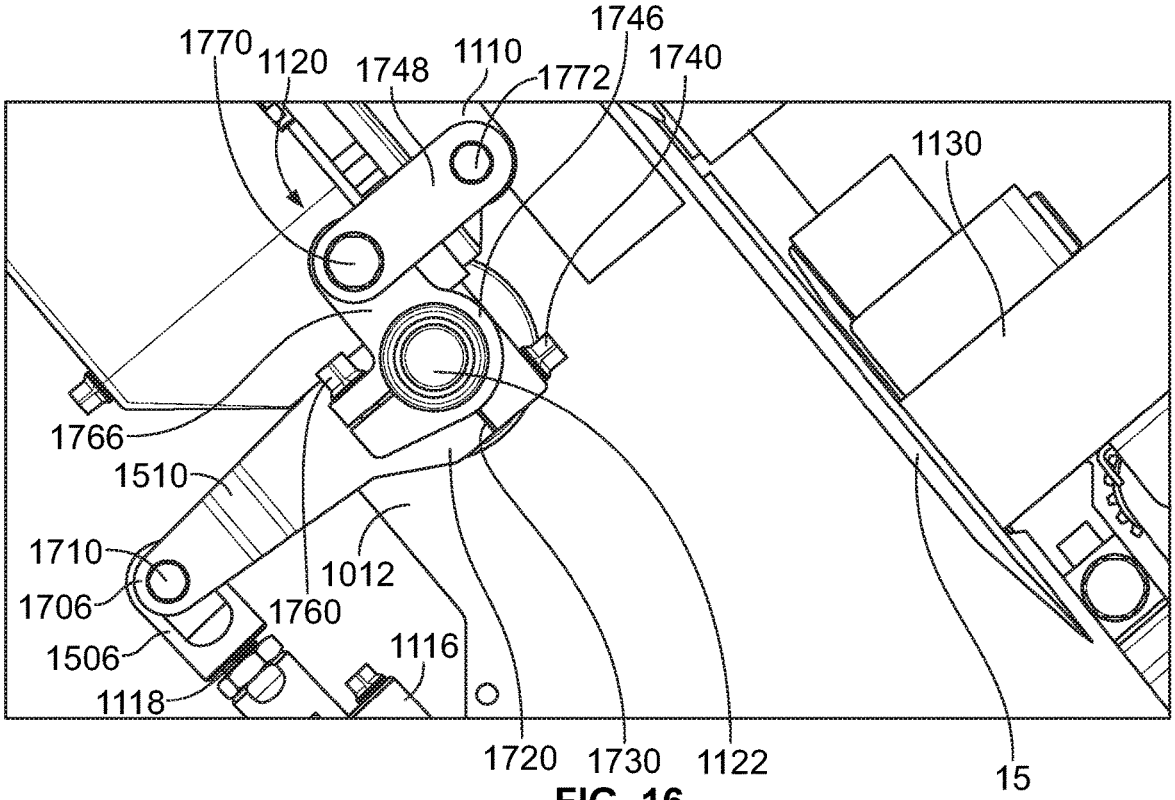
FIG. 16 shows a linkage arrangement between the actuator and the frame of the pivoting blade assembly, in the extended position, according to the embodiment of FIG. 10.
Figure 17:
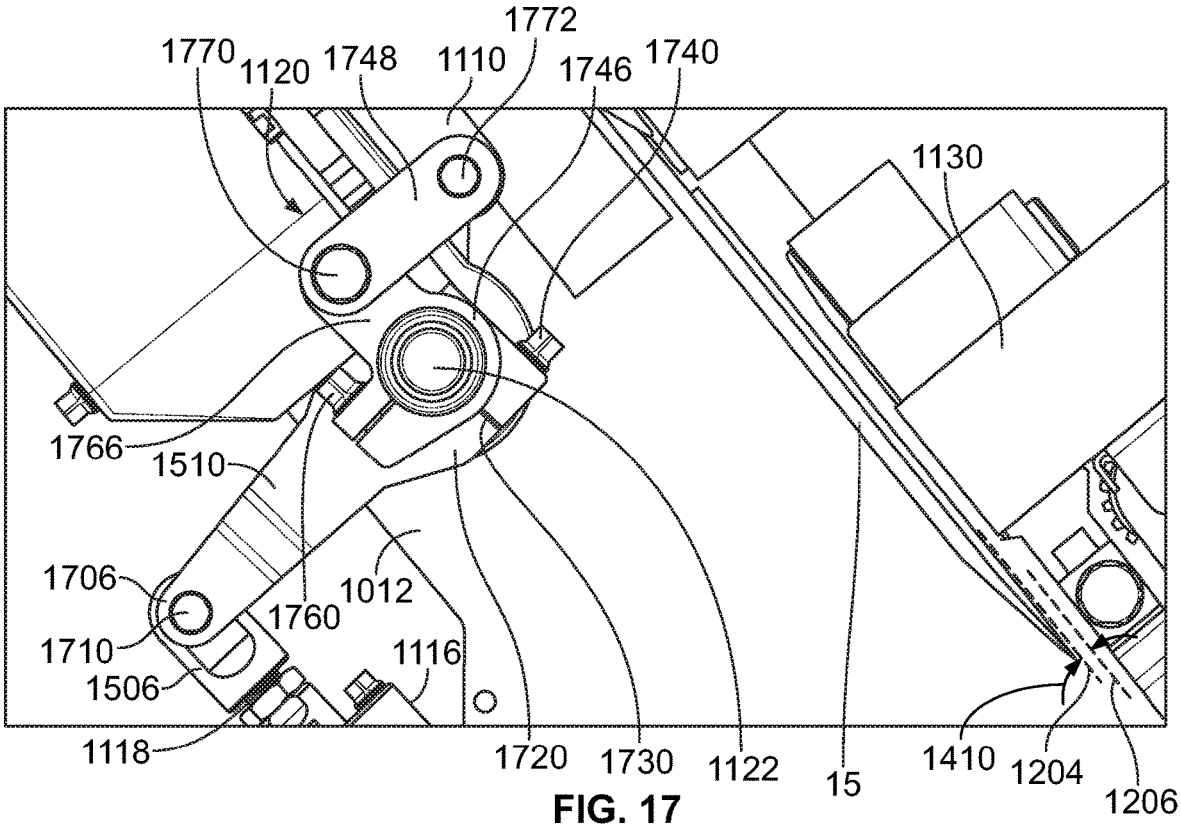
FIG. 17 shows the linkage arrangement between the actuator and the frame of the pivoting blade assembly, in the retracted position, according to the embodiment of FIG. 10.

The left and right side linkages 1120 are shown in greater detail in FIGS. 13-17. The linkages 1120 permit the pivoting blade assembly 1006 to reciprocally move between the extended and retracted positions, as powered by the actuator cylinder 1116. As shown in FIGS. 13, 14, and 17, the pivoting blade assembly 1006 is in the retracted position, which is indicated by the directional arrow "R" for "retracted" in FIG. 15 when the cylinder rod 1118 is retracted into the cylinder 1116, and is in a fully backward position, as shown by arrow "B" for "backward" in FIG. 15.

Conversely, when the cylinder rod 1118 is moved in the forward direction as shown by arrow "F" for "forward" in FIG. 15, the pivoting blade assembly 1006 is in extended position, as shown in the directional arrow "E" for "extended," and which extended position can be seen in FIG. 16. As can be understood by FIGS. 15-17, the linkages 1120 translate linear movement of the cylinder rod 1118, as shown by arrows "F" and "B" of FIG. 15 into pivoting movement of the pivoting blade assembly 1006, as shown by arrows "E" and "R."

The cylinder rod 1118 terminates at a cylinder rod head 1506, which preferably attaches to the cylinder rod 1118 with a threaded connection, although any suitable connection structure may be used. The cylinder rod head 1506, in turn, is operatively coupled to a connecting arm 1510. The connecting arm 1510, which may have a first or forked end 1706 (which fork preferably has parallel portions, as best seen in FIG. 15), may be coupled to the cylinder rod head 1506 with a fork bolt 1710.

Preferably, when the fork bolt 1710 is fully tightened, the connecting arm 1510 is still able to freely move or pivot about the fork bolt 1710 due to the forked configuration 1706, the spacing between forked portions, and rigidity thereof, so as to prevent frictional compression of the forked end 1706 against the cylinder rod head 1506. Thus, the connecting arm 1510 can freely pivot about the fork bolt 1710 as the cylinder rod 1118 moves forward and backward.

As described above with respect to FIGS. 11 and 15-17, the driven reciprocating shaft 1122 is secured between opposite parallel support arms 1012 and is able to reciprocally pivot or freely rotate between the support arms 1012. As best shown in FIGS. 15-17, to drive or pivot the driven reciprocating shaft 1122, a clamp end 1720 of the connecting arm 1510 is fixedly secured to the driven reciprocating shaft 1122. The clamp end 1720 of the connecting arm 1510 is formed with a through bore configured to receive the driven reciprocating shaft 1122 therethrough, and is arranged in a split ring configuration, with the split 1730 clearly visible in FIGS. 15-17.

When a first split ring compression bolt 1740 is tightened, the clamp end 1720 compresses and tightens about the driven reciprocating shaft 1122, thus fixedly securing the clamp end 1720 of the connecting arm 1510 to the driven reciprocating shaft 1122. In this way, as the connecting arm 1510 pivots during movement of the cylinder rod 1118, the driven reciprocating shaft 1122 rotates accordingly.

Because only one actuator cylinder 1116 is needed, only one connecting arm 1510 is provided. However, for purposes of balance, reduction of vibration, and torque balancing, two sets of linkages 1120 may be provided, one at opposite ends of the driven reciprocating shaft 1122, namely the left side linkages and the right side linkages 1120, both of which may be composed of several identical structural components.

Each of the left side linkages and the right side linkages 1120 may include a fixed link 1746 and a free link 1748. The fixed link 1746 has a split ring clamping configuration similar to that of the split ring configuration of the clamp end 1720 of the connecting arm 1510. Similarly, when a second split ring compression bolt 1760 is tightened, the fixed link 1746 tightens about the driven reciprocating shaft 1122 so that rotational movement of the driven reciprocating shaft 1122 rotationally powers the fixed link.

To make the final operative structural coupling between the actuator cylinder 1116 and the pivoting blade assembly 1102, the free link 1748 operatively couples a stub end 1766 of the fixed link 1746 to the housing support rails 1110. As described above, the left and right side linkages 1120 may be identical.

A first free link bolt 1770 pivotally couples the stub end 1766 of the fixed link 1746 to one end of the free link 1748, while a second free link bolt 1772 pivotally couples the other end of the free link 1748 to the housing support rail 1110. The first and second free link bolts 1770, 1772 are configured, either with spacers or appropriate threaded and non-threaded portions, to permit free pivotal movement of each end of the free link 1740, relative to the stub end 1766 and the support rails 1110, respectively. In some embodiments, ends of the fixed link 1746 and/or ends of the free link 1748 may also have a parallel forked arrangement for secure pivotal coupling.

Note that in FIGS. 13 and 17, the blade 15 is shown in the retracted position, thus the plane of the cutting blade 1204 is disposed at the predetermined angle 1410 away from the cutting plane 1206 of the food product 1130. The predetermined angle 1410 is preferably about 5.6 degrees, but in the figures shown, due to the scale, the angle is difficult to visualize. Such predetermined angle is shown more clearly in the enlarged an exaggerated view of FIG. 14.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true scope of the subject matter described herein. Furthermore, it is to be understood that the disclosure is defined by the appended claims.

Accordingly, the disclosure is not to be restricted except in light of the appended claims and their equivalents.

The invention claimed is:

1. A food slicing system comprising:

an input conveyor configured to transport a food product for slicing;

a slicing assembly configured to slice the food product into a plurality of slices to form a sliced food product;

an output conveyor configured to receive thereon, the sliced food product;

a pair of parallel support arms;

the slicing assembly located at a downstream location relative to the input conveyor, and operatively supported by support arms;

the slicing assembly further comprising:

a support frame;

a cutting blade;

a motor configured to operatively drive the cutting blade; and a horizontal support shaft coupled between the support arms and configured to pivotally support the support frame;

an actuator operatively coupled to the support arms and configured to produce a reciprocal movement by reciprocally moving the support frame between an extended position and a retracted position, the support frame pivoting about the horizontal support shaft during the reciprocal movement;

a lower reciprocating shaft operatively supported by the support arms and configured to reciprocally rotate when operatively driven by the actuator;

a linkage arrangment operatively coupled between the actuator and the support frame and configured to cause the pivoting of the support frame about the horizontal support shaft; and the linkage arrangement having a fixed link operatively coupled to the lower reciprocating shaft configured to fixedly rotate along with the lower reciprocating shaft, a free link having a first end operatively coupled to a portion of the fixed link, and the free link having a second end operatively coupled to a lower portion of slicing assembly;

wherein when the support frame is in the extended position, a plane of the cutting blade is substantially co-planar with a cutting plane of the food product, and the cutting blade is configured to slice the food product; and wherein when the support frame is in the retracted position, the plane of the cutting blade is within a predetermined angular range disposed away frome the cutting plane of the food product, and the cutting blade does not contact the food product.

2. The system of claim 1, wherein when the support frame is in the retracted position, the angular range of the plane of the cutting blade is between 4 degrees and 8 degrees away from the cutting plane of the food product.

3. The system of claim 1, wherein when the support frame is in the retracted position, the angular range of the plane of the cutting blade is between 2 degrees and 10 degrees away from the cutting plane of the food product.

4. The system of claim 1, wherein when the support frame is in the extended position, the plane of the cutting blade is substantially co-planar with the cutting plane of the food product within a tolerance of between +0.50 degrees and −0.50 degrees.

5. The system of claim 1, wherein when the support frame is in the extended position, the plane of the cutting blade is at a cutting angle of between 0.0 degrees and −3.0 degrees relative to the cutting plane of the food product, wherein a negative value of the cutting angle compensates for blade wear.

6. The system of claim 1, wherein the motor that drives the cutting blade is a servomotor.

7. The system of claim 1, wherein the actuator is a linear electric servomotor.

8. The system of claim 1, wherein the actuator is one of an electric actuator, a pneumatic actuator, an hydraulic actuator, and a stepper motor.

9. The system of claim 1, wherein the support frame is moved from the extended position to the retracted position after a sliced stack having a predetermined number of slices, is produced, wherein the movement between the extended and retracted position is controlled automatically.

10. The system of claim 1, wherein the linkage arrangement is configured to translate linear movement of the actuator into pivoting movement of the support frame about the horizontal support shaft.

11. The system of claim 1, further including:

an actuator rod powered by the actuator;

an actuator rod linkage having a first end pivotally coupled to an end of the actuator rod; and the actuator rod linkage having a second end fixedly coupled to the lower reciprocating shaft; and wherein linear movement of the actuator rod is translated to rotational movement of the lower reciprocating shaft.

12. A food slicing system comprising:

a slicing assembly including a slicing assembly support frame and a cutting blade, the cutting blade configured to slice a food product into a plurality of food slices, the cutting blade slicing the food product along a cutting plane of the food product;

the slicing assembly supported by a pair of support arms, and further including:

a motor configured to operatively drive the cutting blade;

a horizontal support shaft supported by the pair of support arms, operatively coupled to an upper portion of the slicing assembly support frame, and configured to permit pivotal movement of the slicing assembly support frame about the horizontal support shaft between an extended position and a retracted position; and at least one rail fixedly attached to the slicing assembly support frame of the slicing assembly;

wherein when the slicing assembly support frame is in the extended position, a plane of the cutting blade is substantially co-planar with the cutting plane of the food product, and when the slicing assembly support frame is in the retracted position, the plane of the cutting blade is within a predetermined angular range disposed away from the cutting plane of the food product;

an actuator supported by the pair of support arms, the actuator having an actuator rod powered by the actuator;

a reciprocating drive shaft supported by the pair of support arms, and configured to reciprocally pivot when driven by the actuator rod;

a linkage arrangement having a fixed link, and a free link operatively coupled to the fixed link, wherein a portion of the free link is operatively coupled to a lower portion of the slicing assembly support frame, the actuator road operatively coupled to the fixed link, wherein reciprocal linear movement of the actuator rod causes the pivotal movement of the slicing assembly support frame about the horizontal support shaft via the free link, to move the slicing assembly support frame between the extended position and the retracted position, respectively;

wherein the linkage arrangement is configured to translafte linear movement of the actuator rod into the pivotal movement of the slicing assembly support frame;

wherein when the slicing assembly support frame is in the extended position, the cutting blade slices the food product; and wherein when the slicing assembly support frame is in the retracted position, the cutting blade does not contact the food product.

* * * * *